US009377226B2

(12) United States Patent
Kang

(10) Patent No.: US 9,377,226 B2
(45) Date of Patent: Jun. 28, 2016

(54) EVAPORATOR AND TURBO CHILLER INCLUDING THE SAME

(71) Applicant: LG ELECTRONICS INC., Seoul (KR)

(72) Inventor: Jungho Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 73 days.

(21) Appl. No.: 14/091,260

(22) Filed: Nov. 26, 2013

(65) Prior Publication Data

US 2014/0150490 A1 Jun. 5, 2014

(30) Foreign Application Priority Data

Nov. 30, 2012 (KR) ..... 10-2012-0137918
Dec. 6, 2012 (KR) ..... 10-2012-0140882

(51) Int. Cl.

| | |
|---|---|
| ***F28D 7/10*** | (2006.01) |
| ***F25B 39/02*** | (2006.01) |
| ***F25B 1/053*** | (2006.01) |
| ***F28D 3/04*** | (2006.01) |
| ***F28D 5/02*** | (2006.01) |
| *F28D 21/00* | (2006.01) |

(52) U.S. Cl.

CPC ..... *F25B 39/028* (2013.01); *F25B 1/053* (2013.01); *F28D 3/04* (2013.01); *F28D 5/02* (2013.01); *F25B 2339/024* (2013.01); *F25B 2339/047* (2013.01); *F28D 2021/0064* (2013.01)

(58) Field of Classification Search

CPC ..... F25B 39/028; F28D 3/04; F28D 7/16; F28D 7/1607; F28D 21/0017; F28D 5/02; F28D 1/05333

USPC ..... 165/157

See application file for complete search history.

(56) References Cited

U.S. PATENT DOCUMENTS 5,561,987 A * 10/1996 Hartfield ..... B01D 1/04 165/117
6,127,571 A * 10/2000 Mulvaney, III ..... B01F 5/0643 562/98
6,883,596 B2 * 4/2005 Kim ..... F25B 39/04 159/13.3
2013/0277018 A1 * 10/2013 Numata ..... F28D 3/02 165/157

* cited by examiner

*Primary Examiner* — Allen Flanigan
*Assistant Examiner* — Filip Zec
(74) *Attorney, Agent, or Firm* — Ked & Associates, LLP

(57) ABSTRACT

An evaporator and a turbo chiller including the evaporator are provided. The evaporator may be a falling film evaporator which may distribute refrigerant to a heat pipe uniformly and which may also control two-phase flow by lowering dynamic pressures of gas refrigerant and liquid refrigerant, and separate the liquid refrigerant and the gas refrigerant from each other to enhance heat exchange efficiency.

19 Claims, 6 Drawing Sheets

EVAPORATOR AND TURBO CHILLER INCLUDING THE SAME

CROSS-REFERENCE TO RELATED APPLICATION(S)

This application claims priority under 35 U.S.C. §119 to Korean Application Nos. 10-2012-0137918 filed in Korea on Nov. 30, 2012, and 10-2012-0140882 filed in Korea on Dec. 6, 2012, whose entire disclosures are hereby incorporated by reference.

BACKGROUND

1. Field

This relates to an evaporator, and in particular to an evaporator for use with a turbo chiller and a turbo chiller including the same.

2. Background

A turbo chiller may use refrigerant to perform heat exchange between chilled water and condensed water. Such a turbo chiller may include a compressor, an evaporator, a condenser and an expansion valve. A compressor used in a turbo chiller may include an impeller rotatable in response to a driving force generated by a driving motor, a shroud for accommodating the impeller and a variable diffuser configured to convert kinetic energy of a fluid exhausted by the rotation of the impeller into pressure energy.

BRIEF DESCRIPTION OF THE DRAWINGS

The embodiments will be described in detail with reference to the following drawings in which like reference numerals refer to like elements wherein.

DETAILED DESCRIPTION

Figure 1:
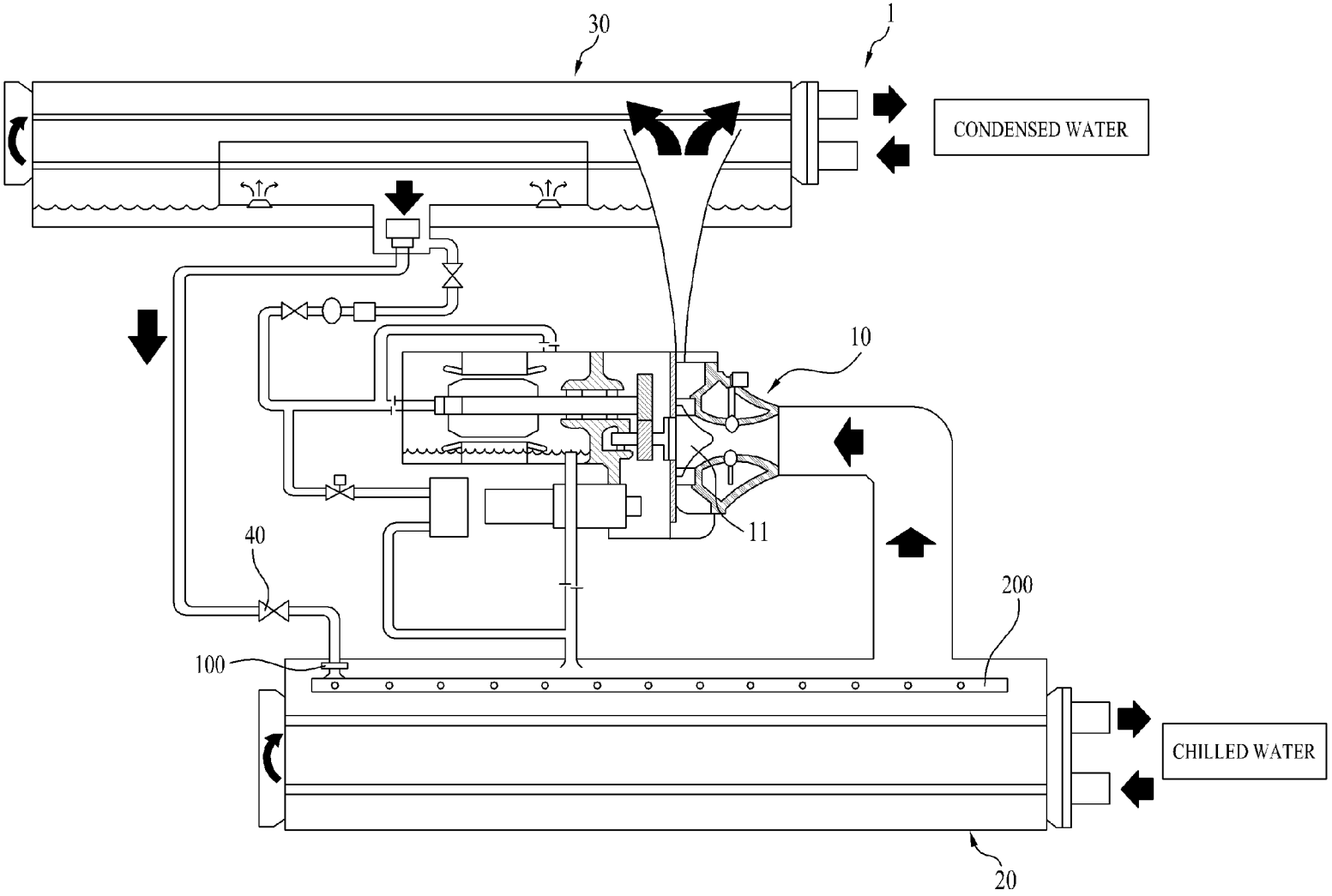
FIG. 1 is a conceptual diagram of a turbo chiller according to one embodiment as broadly described herein.

An evaporator and a turbo chiller according to exemplary embodiments are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements.

In a turbo chiller according to one embodiment, the evaporator and the condenser may have a shell-in-tube structure so that chilled water and condensed water may flow along a tube and the refrigerant may be provided to a shell. The water may be drawn into and discharged from the evaporator, and the refrigerant and the water may undergo heat-exchange in the evaporator so that the water is cooled while passing through the evaporator. The condensed water may be drawn into and exhausted from the condenser so that the refrigerant and the condensed water undergo heat-exchange in the condenser and the condensed water may be heated while passing through the condenser.

In a case in which the evaporator is a falling film evaporator, the refrigerant drawn into the evaporator may be uniformly dispersed to a heat pipe having the chilled water flowing therein by a distribution device. In this situation, two-phase flow of a liquid refrigerant and a gaseous refrigerant which are drawn into the evaporator may be controlled so as to disperse the refrigerant to the heat pipe uniformly via the distribution device. Specifically, a mixture of gaseous and liquid refrigerant may be drawn into the evaporator, with a flow speed of the two-phase refrigerants flowing along a pipe being relatively high, making uniform distribution somewhat difficult. Moreover, separation of the gaseous refrigerant and the liquid refrigerant may be difficult in this two-phase flow situation due to difficulty in adjusting dynamic pressure of the gaseous refrigerant to dynamic pressure of the liquid refrigerant, further impacting the ability to uniformly distribute refrigerant.

Accordingly, a structure capable of effectively separating the liquid and gaseous refrigerants from the refrigerant drawn into the evaporator and controlling the two-phase flow by lowering the dynamic pressures of the liquid and gaseous refrigerants may allow the distribution device to distribute the refrigerant to the heat pipe uniformly, employing a simple shape/structure to provide for uniform distribution and flow of refrigerant.

Referring to FIG. 1, a turbo chiller 1 according to one embodiment as broadly described herein may include a compressor 10 for compressing a refrigerant, a condenser 30, an expansion valve 40 and an evaporator 20. The compressor 10 may include an impeller 11 for compressing the refrigerant and the condenser 30 may perform heat exchange between condensed water and refrigerant drawn from the compressor 10. The evaporator 20 may perform heat exchange between water and the refrigerant exhausted from the condenser 30, and the expansion valve 40 may be provided between the condenser 30 and the evaporator 20.

The compressor 10 may perform one-stage or two-stage compression, with the impeller 11 rotatable in response to a driving force generated by a driving motor to compress the refrigerant. The compressor 10 may further include a shroud for accommodating the impeller 11 and a variable diffuser for converting kinetic energy of a fluid exhausted by the rotation of the impeller 11 into pressure energy. In the exemplary embodiment shown in FIG. 1, the compressor 10 includes a one-stage compression device.

In one embodiment, the evaporator 20 and the condenser 30 may have a shell-in-tube structure in which water (to the evaporator) and condensed water (to the condenser) may flow through a tube and a predetermined amount of refrigerant may be provided in a shell. Chilled water may be drawn into and exhausted from the evaporator 20. Heat exchange between the refrigerant and the chilled water may be performed in the evaporator 20. Accordingly, the water may be chilled while passing through the evaporator 20. The condensed water may be drawn into and exhausted from the condenser 30. Heat exchange between the refrigerant and the condensed water may be performed in the condenser 30. Accordingly, the condensed water may be heated while passing through the condenser 30.

As mentioned above, in certain embodiments the compressor 10 may include a two-stage compression device, and may be a multistage compressor having a plurality of stages. In certain embodiments, the turbo chiller 1 may include such a multistage compressor having a plurality of stages, such as, for example, the compressor 10 including the two-stage compression device.

The turbo chiller 1 may include the condenser 30 for heat exchange between the chilled water and the refrigerant drawn therein from the compressor 10. The turbo chiller 1 may also include an economizer for separating a liquid refrigerant and a gas refrigerant from the refrigerant exhausted by the condenser 30. The economizer may exhaust the separated gas refrigerant to the compressor 10, and the liquid refrigerant may be delivered to the condenser 30. The turbo chiller 1 may include the evaporator 20 for heat exchange between the chilled water and the liquid refrigerant exhausted from the economizer.

In certain embodiments, the turbo chiller 1 may further include a first expansion valve provided between the condenser 30 and the economizer and a second expansion valve provided between the economizer and the evaporator.

In a case in which the compressor 10 includes the two-stage compression device, the compressor 10 may include a low pressure compressing device and a high pressure compression device, with a one-stage impeller provided in the low pressure compression device and a two-stage impeller provided in the high pressure compression device. In addition, the refrigerant exhausted from the evaporator 20 may be drawn into the low pressure compression device and the gas refrigerant separated by the economizer may be drawn into the high pressure compression device.

Accordingly, compression load of the compressor 10 may be reduced, because the gas refrigerant separated by the economizer and the refrigerant compressed by the low pressure compression device may be compressed together. Reduced compression load may improve compressor operation range.

Figure 2:
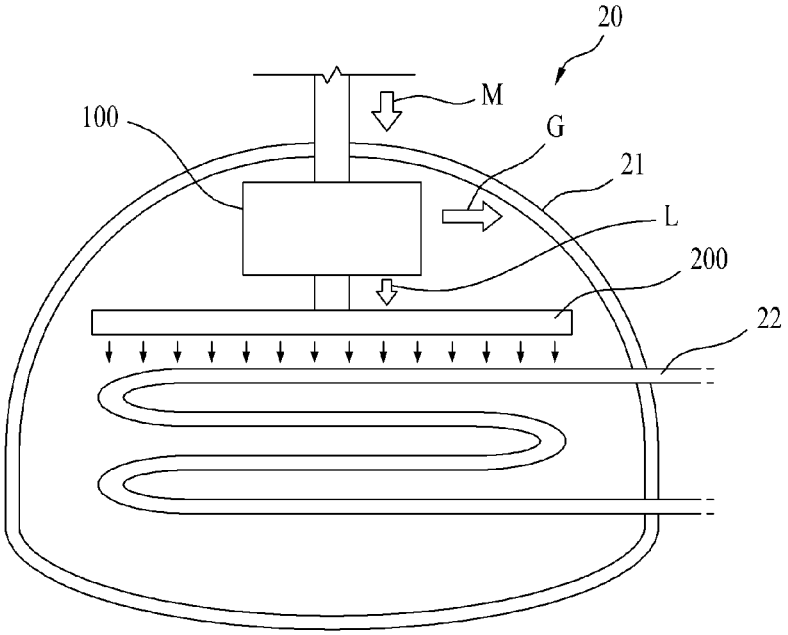
FIG. 2 is a conceptual diagram of an inside of an evaporator of the turbo chiller shown in FIG. 1, according to one embodiment as broadly described herein.

Referring to FIG. 2, the evaporator 20 may be a falling film evaporator. The refrigerant drawn into the evaporator 20 may be uniformly dispersed (distributed) to a pipe 22, in other words, a heat pipe 22 in which the water flows, by a distribution device 200.

The two-phase flow of the liquid refrigerant (L) and the gas refrigerant (G) from the refrigerant drawn into the evaporator 20 may be controlled so as to distribute the refrigerant to the pipe 22. Specifically, a mixture (M) of the gas and liquid refrigerants may be drawn into the evaporator 20 and the speeds of the two-phase refrigerants (L and G) flowing along the refrigerant pipe may be different from each other, such that it may be difficult for the distribution device 200 to uniformly distribute the refrigerant, and may make separation the gas refrigerant (G) and the liquid refrigerant (L) difficult and inconsistent. Also, it may be difficult to adjust a dynamic pressure of the gas refrigerant (G) and a dynamic pressure of the liquid refrigerant (L) to each other. Accordingly, it may be difficult for the distribution device 200 to uniformly distribute the refrigerant mixture to the heat pipe 22.

The evaporator 20 according to one embodiment may be a falling film evaporator having a shell-in-tube structure. In other words, the heat pipe 22 in which the water flows may be provided in a shell 21 and a separation device 100 and the distribution device 200 may be provided in the shell 21.

Alternatively, only the distribution device 200 may be provided in the shell 21, or the distribution device 200 and the separation 100 device may be provided in the shell 21 together, as shown in FIG. 2. The case in which only the distribution device 200 is provided in the shell 21 will be described first.

The evaporator 20 may be applied to, for example, a turbo chiller 1. However, the present disclosure is not limited thereto and the evaporator 20 may be applied to various other types of refrigeration systems, heating/air conditioning systems and the like.

Specifically, the evaporator 20 may include the distribution device 200 and the heat pipe 22 in which water flows to undergo heat exchange with the refrigerant distributed by the distribution device 200. The distribution device 200 may distribute the refrigerant along a longitudinal direction and/or a width direction of the distribution device 200, and may, for example, disperse the refrigerant primarily along the longitudinal direction, and secondarily along the width direction. Alternatively, the distribution device 200 may disperse the refrigerant primarily along the width direction and secondarily along the longitudinal direction.

The distribution device 200 may include a plurality of plates. A plurality of flow channels may be provided in each of the plates. Each of the plates may be substantially the same or similar size. The longitudinal direction of the distribution device 200 may refer to a longitudinal direction of a plate provided in the distribution device 200 and the width direction of the distribution device 200 may refer to a width direction of the plate provided in the distribution device 200.

The longitudinal length of each plate may be greater than the traverse length (i.e., the width) of the plate in the distribution device 200. Also, the longitudinal direction may be substantially perpendicular to the width direction.

Specifically, the distribution device 200 may include a first plate 210 having a plurality of flow channels extending in the longitudinal direction of the distribution device 200. The distribution device 200 may also include a second plate 220 having a plurality of flow channels extending in the width direction of the distribution device 200 so that the refrigerant delivered from the first plate 210 may flow along the second plate 220.

Figure 4:
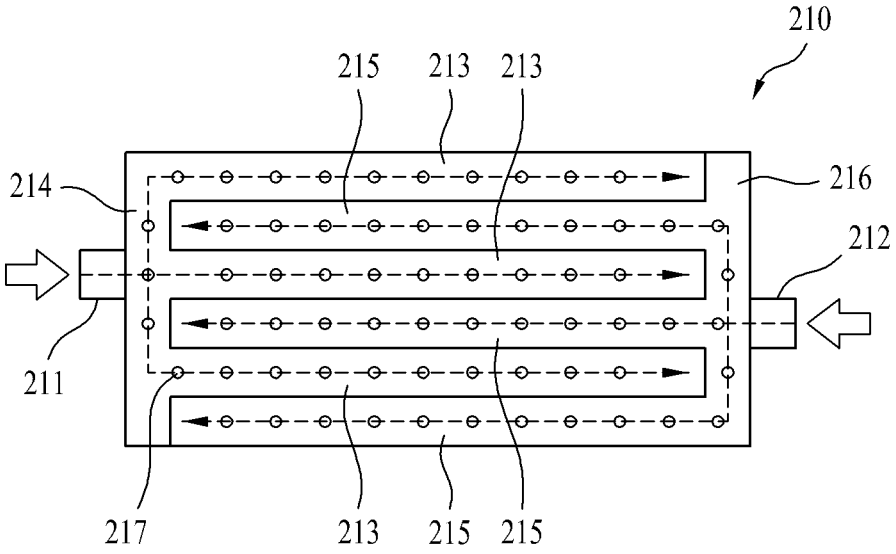
FIGS. 4 through 6 are conceptual diagrams of a first plate and a second plate of the distribution device shown in FIG. 3.

As shown in FIG. 4, the first plate 210 may include a first refrigerant inlet 211, a second refrigerant inlet 212, a first flow channel 213 guiding refrigerant from the first refrigerant inlet 211 toward the second refrigerant inlet 212, and a second flow channel 215 guiding refrigerant from the second refrigerant inlet 212 toward the first refrigerant inlet 211.

Figure 3:
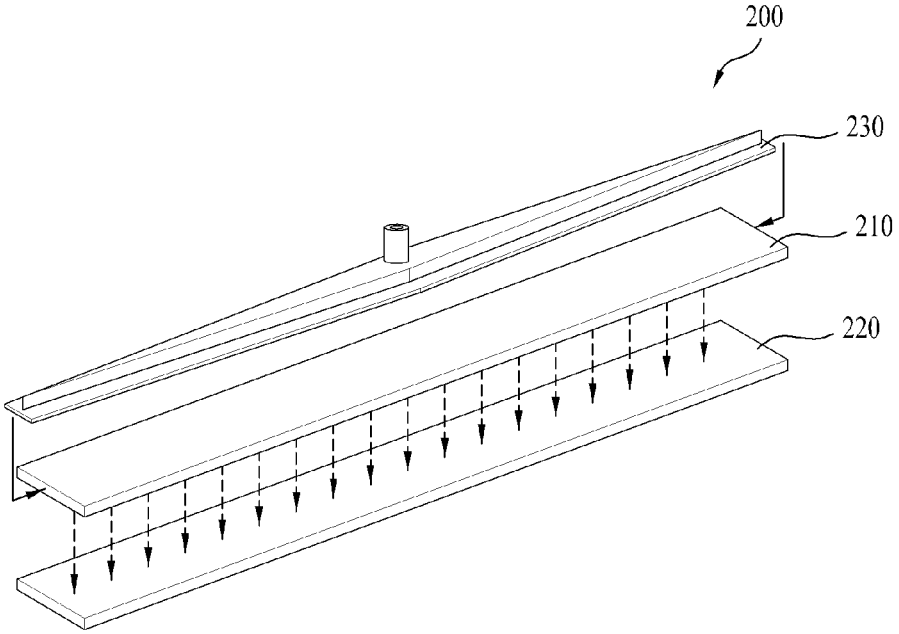
FIG. 3 is a conceptual diagram of a distribution device of the evaporator shown in FIG. 2, according to one embodiment as broadly described herein.

Referring to FIGS. 3 and 4, the first plate 210 may include two refrigerant inlets 211 and 212. In other words, the refrigerant drawn into the evaporator 20 may be provided to the distribution device 200 via the plurality of the refrigerant inlets 211 and 212. The first refrigerant inlet 211 and the second refrigerant inlet 212 may be provided in the first plate 210, facing each other. In one embodiment, the first refrigerant inlet 211 and the second refrigerant 212 may be respectively provided at two opposite longitudinal ends of the first plate 210.

In certain embodiments, the first flow channel 213 and the second flow channel 214 may extend in the longitudinal direction of the first plate 210. Specifically, the first flow channel 213 may extend from the first refrigerant inlet 211 toward the second refrigerant inlet 212 along the longitudinal direction of the first plate 210, so that the refrigerant drawn through the first refrigerant inlet 211 flows along the first flow channel 213. In contrast, the second flow channel 215 may extend from the second refrigerant inlet 212 toward the first refrigerant inlet 211 along the longitudinal direction of the first plate 210 so that the refrigerant drawn through the second refrigerant inlet 212 flows along the second flow channel 215.

The first refrigerant inlet 211 and the second refrigerant inlet 212 may be provided at the two opposite longitudinal ends of the first plate 210, facing each other. The first flow channel 213 may extend from the first refrigerant inlet 211 toward the second refrigerant inlet 212 along the longitudinal direction of the first plate 210. The second flow channel 215 may extend from the second refrigerant inlet 212 toward the first refrigerant inlet 211 along the longitudinal direction of the first plate 210. Specifically, the direction of the refrigerant flowing in the first flow channel 213 may be opposed to the direction of the refrigerant flowing in the second flow channel 214.

The refrigerant drawn into the distribution device 200 may flow in the first plate 210 along the longitudinal direction of the first plate 210 by a uniform average amount. The uniformity of the refrigerant distributed to the heat pipe 22 may be enhanced accordingly.

A plurality of first flow channels 213 and a plurality of second flow channels 215 may be provided. The first and second flow channels 213 and 215 may be alternatively arranged, adjacent to each other along the width direction of the first plate 210. The plurality of first flow channels 213 and the plurality of second flow channels 215 may be provided such that the uniformity of the refrigerant distributed to the heat pipe 22 may be further enhanced.

A first traverse flow channel 214 may connect the plurality of first flow channels 213 to the first refrigerant inlet 211. A second traverse flow channel 216 may connect the plurality of second flow channels 215 to the second refrigerant inlet 212.

A plurality of first flow holes 217 may be provided in the first plate 210 to discharge the refrigerant from the first flow channel 213 and the second flow channel 215. In other words, the refrigerant flowing in the first plate 210 may be delivered to the second plate 220 via the first flow holes 217.

The distribution device 200 may also include a third plate 230 configured to transfer the refrigerant drawn into the evaporator 20 to the first refrigerant inlet 211 and the second refrigerant inlet 212.

The second plate 220 may include a third flow channel 221 and a fourth flow channel 223 through which refrigerant transferred thereto via the first flow holes 217 may flow. Specifically, the refrigerant drawn into the distribution device 200 may be distributed to the heat pipe 22 after flowing sequentially along the first plate 210 and then along the second plate 220. The third flow channel 221 and the fourth flow channel 223 may extend in the width direction of the second plate 220. The direction of the refrigerant flowing in the third flow channel 221 may be opposite of the refrigerant flowing in the fourth flow channel 223. A plurality of third flow channels 221 and a plurality of fourth flow channels 223 may be provided in the second plate 220, with a fourth flow channel 223 provided between two neighboring third flow channels 221.

A first longitudinal flow channel 222 may be provided in the second plate 220 to connect the two neighboring two third flow channels 221 to each other. A second longitudinal flow channel 224 may connect the two neighboring fourth channels 223 to each other. In one embodiment, referring to FIG. 5, the first flow channel 221 may have an inverted U-shape and the fourth flow channel 223 may have a U-shape.

In certain embodiments, the shape of the third flow channel 221 may be symmetrical to the shape of the fourth channel 223.

A plurality of second flow holes 225 may be provided in the second plate 220 to discharge refrigerant flowing in the third flow channel 221 and the fourth flow channel 223. Accordingly, the refrigerant may be discharged to the heat pipe 22 via the second flow holes 225.

Figure 5:
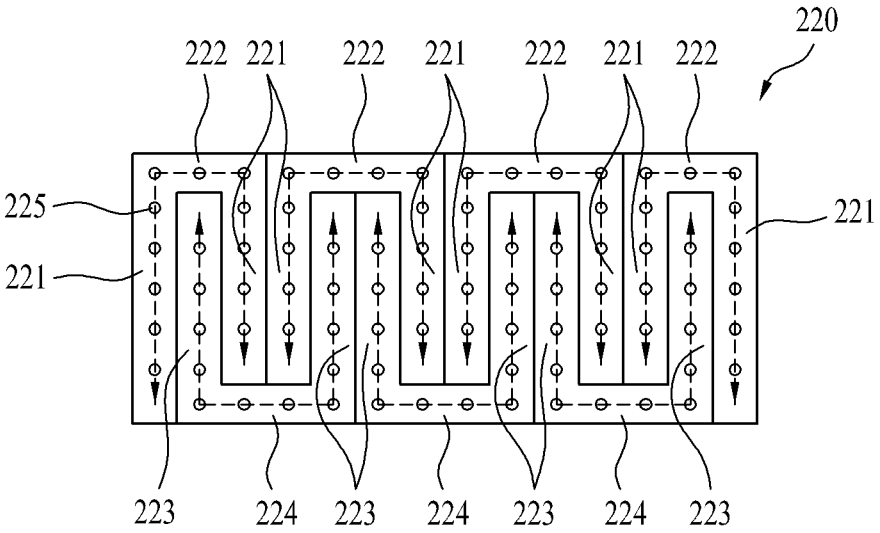
Figure 6:
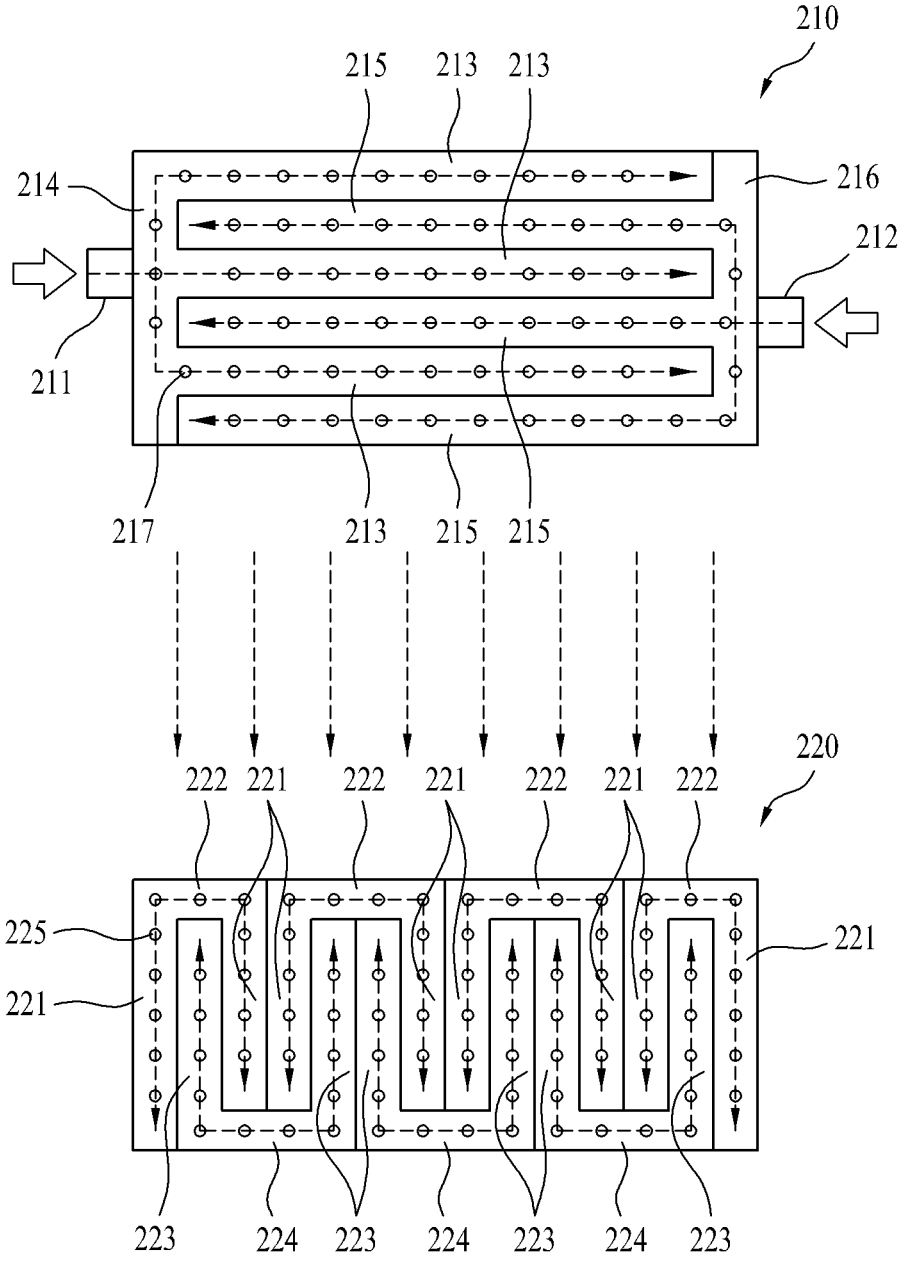

Referring to FIGS. 4 and 5, the first plate 210 and the second plate 220 may have a rectangular cross section with a predetermined length and width.

In the structure of the first plate 210, the first flow channel 213 and the second flow channel 215 may be longer than the first and second traverse flow channels 214 and 216. In the structure of the second plate 220, the third flow channel 221 and the fourth flow channel 223 may be longer than the first and second longitudinal flow channels 222 and 224.

The refrigerant drawn into the distribution device 200 may be drawn into the first refrigerant inlet 211 and the second refrigerant inlet 212 of the first plate 210 via the third plate 230. The refrigerant drawn into the distribution device 220 may be distributed along the width direction of the first plate 210 by a uniform average flow amount, while flowing in the second plate 220. Accordingly, the uniformity of the refrigerant distributed to the heat pipe 22 may be enhanced.

The refrigerant may be exhausted to the second plate 220 via the first flow holes 217 while flowing in the first flow channel 213 and the second flow channel 215. The refrigerant drawn into the second plate 220 may then be distributed to the heat pipe 22 via the second flow holes 225 while flowing in the third flow channel 221 and the fourth flow channel 223.

The refrigerant drawn into the distribution device 200 may be distributed along the longitudinal direction of the first plate 210 by a uniform average amount, while flowing in the first plate 210. The refrigerant may be distributed along the width direction of the second plate 220 by a uniform average amount, while flowing in the second plate 220. Accordingly, the uniformity of the refrigerant distributed to the heat pipe 22 may be enhanced.

Figure 7:
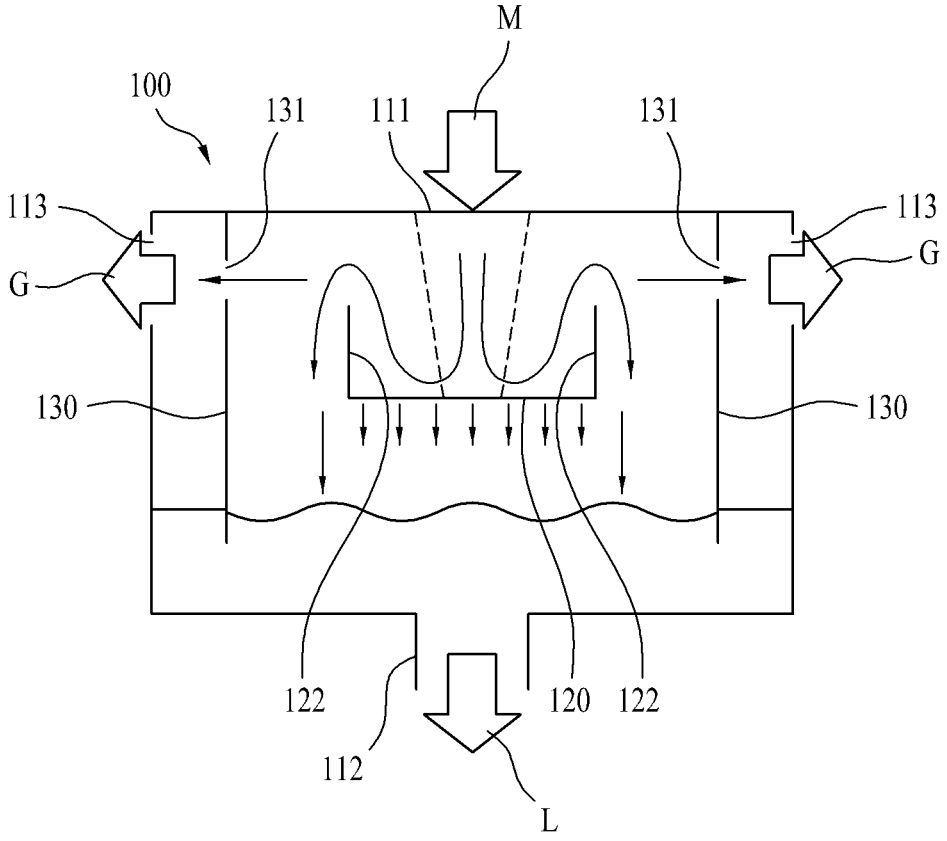
FIGS. 7 and 8 are conceptual diagrams of a separation device of the evaporator shown in FIG. 2, according to one embodiment as broadly described herein.

FIG. 7 is a conceptual diagram of the separation device 100 provided in the evaporator 20, according to one embodiment, which may provide the refrigerant to the distribution device 200.

As mentioned above, it may be beneficial to uniformly distribute the refrigerant to the heat pipe 22, and to separate the liquid refrigerant and the gas refrigerant from each other so as to provide only the liquid refrigerant to the distribution device 200. Specifically, it may be beneficial to control the two-phase flow of the liquid refrigerant (L) and the gas refrigerant (G) from the refrigerant (M) drawn into the evaporator 20 so that the distribution device 200 may uniformly distribute the refrigerant to the heat pipe 22. In other words, it may be beneficial to separate the liquid refrigerant and the gas refrigerant from the refrigerant mixture drawn into the evaporator 20 effectively, and to control the flow of the two-phase refrigerants by smoothly lowering the dynamic pressure of the liquid refrigerant and the gas refrigerant.

Referring to FIG. 7, the separation device 100 may include a housing 110 having a refrigerant inlet 111, at least one gas refrigerant outlet 113 and a liquid refrigerant outlet 112. A baffle plate 120 may be arranged between the liquid refrigerant outlet 112 and the refrigerant inlet 111 such that the refrigerant drawn into the housing 110 via the refrigerant inlet 111 impinges on the baffle plate 120. Specifically, referring to FIGS. 2 and 7, the evaporator 20 includes the separation device 100 having the housing 110 including the refrigerant inlet 111, the gas refrigerant outlet(s) 113, the liquid refrigerant outlet 112, and the baffle plate 120, and the pipe 22 where the chilled water flows to exchange heat with the liquid refrigerant distributed by the distribution device 200.

The baffle plate 120 may be provided in the housing 110, high enough to be positioned between the gas refrigerant outlet(s) 113 and the liquid refrigerant outlet 112. The baffle plate 120 may control the two-phase flow of the gas and liquid refrigerants provided to the evaporator 20, specifically, may lower the dynamic pressure of the gas refrigerant and the dynamic pressure of the liquid refrigerant to ease the flow of the two-phase refrigerant.

When the speed of the refrigerant drawn into the refrigerant inlet 111 maintains uniform dynamic pressures of the gas and liquid refrigerants, in other words, when the gas refrigerant and the liquid refrigerant impinge on the baffle plate 120, the speed of the gas refrigerant and the liquid refrigerant flowing from the refrigerant inlet 111 toward the liquid refrigerant outlet 113 may, theoretically approach zero.

Figure 8:
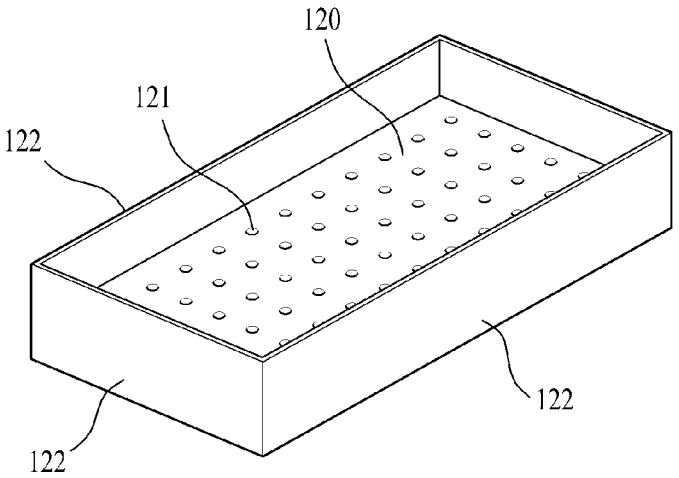

Referring to FIG. 8, a plurality of orifices 121 may be provided in the baffle plate 120. Also, a plurality of anti-overflow protrusions 122, or walls 122, may extend from the baffle plate 120 toward the refrigerant inlet 111. In certain embodiments, the walls 122 may extend from the periphery of the baffle plate 120, so as to enclose or surround the baffle plate 120.

In such a structure, some of the liquid refrigerant (L) may flow to the liquid refrigerant outlet 112 after passing through the orifices 121 and the remaining liquid refrigerant may flow over the baffle plate 120 toward the liquid refrigerant outlet 122.

Referring to FIG. 7, the separation device 100 may include at least one lateral wall 130 provided between the refrigerant inlet 111 and the gas refrigerant outlet 113 such that the gas refrigerant (G) may be guided toward the gas refrigerant outlet 113 along the lateral wall 130 through a hole 131 provided in the lateral wall 130 which is in fluid communication with the gas refrigerant outlet 113. In this structure, the gas refrigerant may be guided along the lateral wall 130 and flow to the gas refrigerant outlet 113 via the hole 131.

In other words, the separation device 100 may not only control the two-phase flow of the liquid refrigerant (L) and the gas refrigerant (G) and but may also effectively separate the liquid refrigerant (L) and the gas refrigerant (G) from each other. Specially, the baffle plate 120 may control the two-phase flow of the liquid refrigerant (L) and the gas refrigerant (G) and the lateral wall 130 may separate the liquid refrigerant (L) and the gas refrigerant (G) from each other.

The separation device 100 may have a structure in which only the liquid refrigerant flows to the distribution device 200 after the liquid refrigerant and the gas refrigerant have been separated due to gravity after impinging on the baffle plate 120.

The lateral wall 130 may also prevent the liquid refrigerant impinging on the baffle plate 120 from being exhausted via the gas refrigerant outlet 113.

The refrigerant inlet 111 may be provided in a top surface of the housing 110. In this instance, the liquid refrigerant outlet 112 may be provided in a bottom surface of the housing 110 and the one or more gas refrigerant outlets 113 may be provided in a lateral surface of the housing 110. The gas refrigerant outlet(s) 113 may be provided high enough so that the liquid refrigerant impinging on the baffle plate 120 is not discharged to the outside therethrough.

Figure 9:
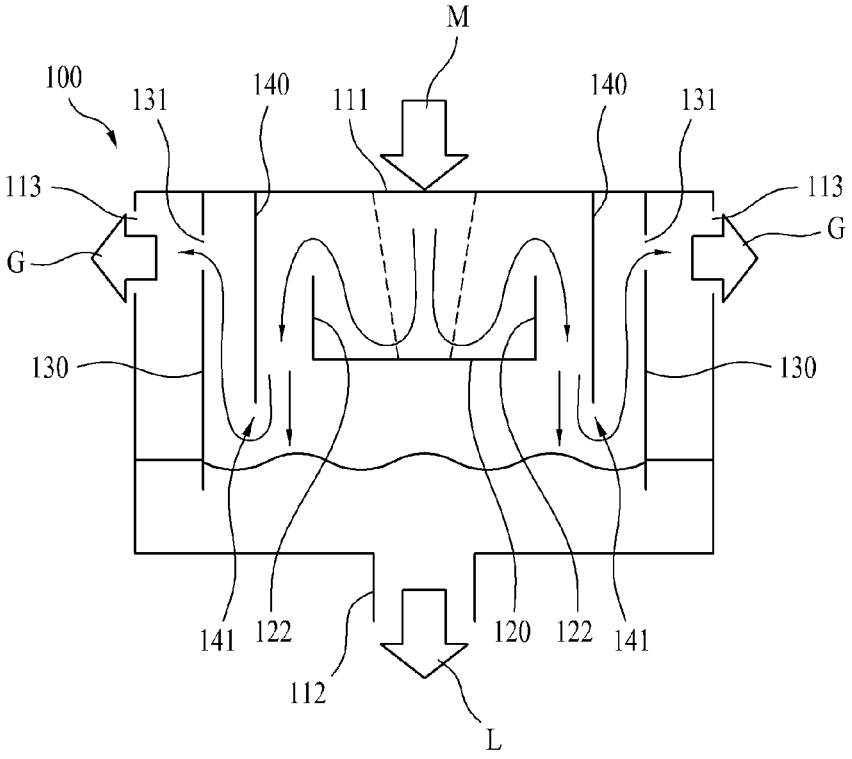
FIG. 9 is a perspective view of a baffle plate of the separation device shown in FIGS. 7 and 8.

Alternatively, referring to FIG. 9, a separation device 100 in accordance with another embodiment may include a plurality of lateral walls 130 and 140 provided between the refrigerant inlet 111 and the gas refrigerant outlet(s) 113, such that the gas refrigerant (G) may be guided to the gas refrigerant outlet(s) 113 along the lateral walls 130 and 140. Accordingly, the separation device 100 may effectively control the two-phase flow of the liquid refrigerant (L) and the gas refrigerant (G) and separate the liquid refrigerant (L) and the gas refrigerant (G) from each other. Specifically, the baffle plate 120 may control the two-phase flow of the liquid refrigerant (L) and the gas refrigerant (G). The lateral walls 130 and 140 may guide the separated gas refrigerant toward the gas refrigerant outlet(s) 113.

The separation device 100 may have a structure in which only the liquid refrigerant separated due to gravity after impinging on the baffle plate 120 together with the gas refrigerant (G) flows to the distribution device 200.

As the liquid refrigerant is drawn into the distribution device 200, there is no two-phase flow in the distribution device 200 and the distribution device 200 may uniformly distribute the liquid refrigerant to the pipe 22.

The plurality of the lateral walls 130 and 140 may guide the gas refrigerant that has impinged on the baffle plate 120 toward the gas refrigerant outlet(s) 113 and may also prevent the liquid refrigerant from being exhausted via the gas refrigerant outlet(s) 113.

Referring to FIG. 9, the plurality of lateral walls 130 and 140 may include a first lateral wall 130 adjacent to a corresponding gas refrigerant outlet 113 and a second lateral wall 140 adjacent to the refrigerant inlet 111. A first hole 131 and a second hole 141 may be provided in the first lateral wall 130 and the second lateral wall 140, respectively, at different heights. The flow direction of the gas refrigerant guided from the baffle plate 120 along the second lateral wall 140 may be opposite that of the gas refrigerant guided from the second lateral wall 140 along the first lateral wall 130. Thus, the first hole 131 may be provided closer to the gas refrigerant outlet 113 and the second hole 141 may be provided closer to the liquid refrigerant outlet 122, and the baffle plate 120 may be provided at a height within the housing 110 between the first hole 131 and the second hole 141. The gas refrigerant (G) exhausted via the gas refrigerant outlet(s) 113 may be provided to the compressor 10, passing through the inside of the evaporator 20.

As shown in FIG. 9, one first lateral wall 130 and one second lateral wall 140 may be positioned corresponding to a first lateral wall of the housing 110 in which a first gas refrigerant outlet 113 is formed, and another first lateral wall 130 and another second lateral wall 140 may be positioned corresponding to a second lateral wall of the housing 110 in which a second gas refrigerant outlet 113 is formed, with holes 131 and 141 respectively formed in the lateral walls 130 and 140 as described above.

Numerous variations and modifications of the system described above may be possible in the component parts and/or arrangements of the subject combination arrangement within the scope of the disclosure, the drawings and the appended claims. In addition to variations and modifications in the component parts and/or arrangements, alternative uses may also be apparent to those skilled in the art.

Exemplary embodiments as broadly described herein provide an evaporator and a turbo chiller including the same which may distribute refrigerant to a heat pipe uniformly, a turbo chiller including the same.

Exemplary embodiments as broadly described herein provide an evaporator and a turbo chiller including the same which may control two-phase flow by lowering dynamic pressures of gaseous and liquid refrigerants sucked therein.

Exemplary embodiments as broadly described herein provide an evaporator and a turbo chiller including the same which may separate a liquid refrigerant and a gaseous refrigerant sucked therein from each other effectively and which may enhance heat exchange efficiency.

Exemplary embodiments as broadly described herein provide an evaporator and a turbo chiller including the same which may distribute a refrigerant by providing only a liquid refrigerant to a distribution unit.

An evaporator, as embodied and broadly described herein, may include a distribution unit including a first refrigerant inlet, a second refrigerant inlet and a plurality of flow channels; and a heat pipe in which chilled for exchanging heat with the refrigerant distributed by the distribution unit flows, wherein the distribution unit comprises a first plate including a plurality of flow channels extended along a longitudinal direction of the distribution unit and a second plate comprising a plurality of flow channels extended along a width direction of the distribution unit to flow the refrigerant transferred from the first plate therein.

The first plate may include a first flow channel extended from the first refrigerant inlet toward the second refrigerant inlet and a second flow channel extended from the second refrigerant inlet toward the first refrigerant inlet, and the first flow channel and the second flow channel may be extended along a longitudinal direction of the first plate.

A direction of the refrigerant flowing in the first flow channel may be opposed to a direction of the refrigerant flowing in the second flow channel.

A plurality of first flow channels and a plurality of second flow channels may be provided and one second flow channel may be provided between two neighboring first flow channels.

A plurality of first flow holes may be provided in the first plate to exhaust the refrigerant to the second plate while the refrigerant is flowing in the first flow channel and the second flow channel.

The second plate may include a third flow channel and a fourth flow channel which are extended along a width direction of the first plate, and a direction of the refrigerant flowing in the third flow channel may be opposed to a direction of the refrigerant flowing in the fourth channel.

A plurality of third flow channels and a plurality of fourth flow channels may be provided, and one fourth flow channel may be provided between two neighboring flow channels along a longitudinal direction of the first plate.

A plurality of flow holes may be provided in the second plate to exhaust the refrigerant outside the second plate while the refrigerant is flowing in the third flow channels and the fourth flow channels.

The first flow channel may have a "∩" shape and the fourth flow channel may have a "∪" shape.

The evaporator may further include a separation unit configured to provide the refrigerant to the distribution unit, wherein the separation unit comprises a housing having a refrigerant inlet, a gas refrigerant outlet and a liquid refrigerant outlet and a baffle plate provided between the liquid refrigerant outlet and the refrigerant inlet to clash the refrigerant drawn via the refrigerant inlet there with.

The baffle plate may be provided in the housing, high enough to be positioned between the gas refrigerant outlet and the liquid refrigerant outlet.

A plurality of orifices may be provided in the baffle plate.

Some of the liquid refrigerant may flow to the liquid refrigerant outlet after passing the orifices and the other liquid refrigerant may overflow the baffle plate toward the liquid refrigerant outlet.

The separation unit may include at least one lateral wall provided between the refrigerant inlet and the gas refrigerant outlet, and the refrigerant may be guided toward the gas refrigerant outlet along the at least one lateral wall.

The lateral wall may include a first lateral wall adjacent to the gas refrigerant outlet and a second lateral wall adjacent to the refrigerant inlet, and a first hole and a second hole may be provided in the first lateral wall and the second lateral wall, respectively, with a different height.

A direction of the gas refrigerant guided from the baffle plate along the second lateral wall may be opposed to a direction of the gas refrigerant guided from the second lateral wall along the first lateral wall.

The first hole may be provided adjacent to the gas refrigerant outlet and the second hole is provided adjacent to the liquid refrigerant outlet.

The baffle plate may be high enough to be positioned between the first hole and the second hole in the housing.

In another embodiment, an evaporator may include a compressor comprising an impeller for compressing a refrigerant; a condenser for heat exchange between the refrigerant drawn from the compressor and chilled water; an evaporator comprising a distribution unit comprising a first refrigerant inlet, a second refrigerant inlet and a plurality of flow channels and a heat pipe in which chilled water for exchanging heat with the refrigerant distributed by the distribution unit flows, the evaporator for heat exchange between the chilled water and the refrigerant exhausted from the condenser; and an expansion valve provided between the condenser and the evaporator, wherein the distribution unit includes a first plate comprising a plurality of flow channels extended along a longitudinal direction of the distribution unit; and a second plate comprising a plurality of flow channels extended along a width direction of the distribution unit to flow the refrigerant drawn from the first plate therein.

The first plate may include a first refrigerant inlet, a second refrigerant inlet, a first flow channel extended from the first refrigerant inlet toward the second refrigerant inlet and a second flow channel extended from the second refrigerant inlet to the first refrigerant inlet, and the second plate may include a third flow channel and a fourth flow channel which are extended along a width direction of the first plate, and the first flow channel and the second flow channel may be extended along a longitudinal direction of the first plate, and a direction of the refrigerant flowing in the third flow channel may be opposed to a direction of the refrigerant flowing in the fourth flow channel.

In another embodiment, an evaporator may include a compressor comprising an impeller for compressing a refrigerant; a condenser for heat exchange between the refrigerant exhausted from the condenser and chilled water; and an expansion valve provided between the condenser and the evaporator, wherein the evaporator includes a separation unit comprising a housing in which a refrigerant inlet, a gas refrigerant outlet and a liquid refrigerant outlet are provided and a baffle plate provided between the liquid refrigerant outlet and the refrigerant inlet to clash the refrigerant drawn via the refrigerant inlet there with; a distribution unit connected to the liquid refrigerant outlet of the separation unit to distribute the liquid refrigerant along a longitudinal direction and a width direction sequentially; and a pipe in which chilled water for exchanging heat with the liquid refrigerant distributed by the distribution unit flows.

As mentioned above, in an evaporator and the turbo chiller including the same, as embodied and broadly described herein, refrigerant may be distributed to the heat pipe uniformly.

In the evaporator and the turbo chiller, the dynamic pressures of the gas refrigerant and the liquid refrigerant may be lowered and the two-phase flow may be controlled.

Furthermore, in the evaporator and the turbo chiller, the liquid refrigerant and the gas refrigerant drawn into the evaporator may be separated from each other effectively. Accordingly, heat exchange efficiency may be enhanced.

Still further, only the liquid refrigerant may be drawn into the distribution unit and the refrigerant may be distributed uniformly.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An evaporator, comprising;

a distribution device having a first refrigerant inlet, a second refrigerant inlet and a plurality of flow channels; and a heat pipe configured to guide a flow of chilled water for heat exchange with refrigerant distributed by the distribution device, wherein the distribution device includes:

a first plate that receives refrigerant from the first and second refrigerant inlets, the first plate having a first plurality of flow channels that extend in a longitudinal direction of the distribution device; and a second plate that receives refrigerant from the first plate, the second plate having a second plurality of flow channels that extend in a width direction of the distribution device, wherein the fast plurality of flow channels formed in the first plate includes:

at least one first flow channel that extends from the first refrigerant inlet toward the second refrigerant inlet, in a longitudinal direction of the first plate; and at least one second flow channel that extends from second refrigerant inlet toward the first refrigerant inlet, in the longitudinal direction of first plate.

2. The evaporator of claim 1, wherein a refrigerant flow direction in the at least one first flow channel is opposite a refrigerant flow direction in the at least one second flow channel.

3. The evaporator of claim 2, wherein the at least one first flow channel includes a plurality of first flow channels and the at least one second flow channel includes a plurality of second flow channels, and wherein the plurality of first flow channels and the plurality of second flow channels ate alternately arranged such that one second flow channel is provided between two neighboring first flow channels.

4. The evaporator of claim 1, further a plurality of first flow holes provided in the first plate to discharge refrigerant from the at least one first flow channel and the at least one second flow channel to the second plate.

5. The evaporator of claim 1, wherein the second plurality of flow channels formed in the second plate includes:

at least one third flow channel extending in a width direction of the first plate; and at least one fourth flow channel extending in the width direction of the first plate, wherein a refrigerant flow direction in the third flow channel is opposite a refrigerant flow direction in the fourth channel.

6. The evaporator of claim 5, wherein the at least one third flow channel includes a plurality of third flow channels and the at least one fourth flow channel includes a plurality of fourth flow channels, and wherein the plurality of third flow channels and. the plurality of fourth flow channels are alternately arranged such that one fourth flow channel is provided between two neighboring third flow channels.

7. The evaporator of claim 6, further including a plurality of second flow holes provided in the second plate to discharge refrigerant from the plurality of third flow channels and the plurality of fourth flow channels.

8. The evaporator of claim 6, wherein the at least one first flow channel has a "∩" shape and the at least one fourth flow channel has a "∪38 shape.

9. The evaporator: of claim 1, further including a separation device configured to provide refrigerant to the distribution device, wherein the separation device includes:

a housing having a refrigerant inlet, at least one gas refrigerant outlet and a liquid refrigerant outlet; and a baffle plate provided between the liquid refrigerant outlet and the refrigerant inlet, wherein the baffle plate is positioned within the housing such that a gas-liquid refrigerant mixture drawn into the housing via the refrigerant inlet impinges on the baffle plate.

10. The evaporator of claim 9, wherein the baffle plate is positioned at a height within the housing between the at least one gas refrigerant outlet and the liquid refrigerant outlet.

11. The evaporator of claim 9, further including a plurality of orifices provided in the baffle plate, wherein a portion of a liquid refrigerant separated from the gas-liquid refrigerant mixture passes through the plurality of orifices, and flows to the liquid refrigerant outlet and the remaining liquid refrigerant overflows the baffle plate and flows toward the liquid refrigerant outlet.

12. The evaporator of claim 9, wherein the separation device further includes at least one lateral wall provided between the refrigerant inlet and the at least one gas refrigerant outlet, wherein gas refrigerant separated from the gas-liquid refrigerant mixture is guided toward the at least one as refrigerant outlet along the at least one lateral wall.

13. The evaporator of claim 12, wherein the at least one lateral wall includes:

first lateral wall positioned adjacent to the gas refrigerant outlet, the first lateral wall having a first hole formed therein; and a second lateral wall positioned adjacent to the refrigerant inlet, the second lateral wall having a second hole formed therein, at a different height than a height of the first hole.

14. The evaporator of claim 13, wherein a flow direction of the gas refrigerant guided from the baffle plate along the second lateral wall is opposite a flow direction of the gas refrigerant guided from the second lateral wall along the first lateral wall toward the at least one gas refrigerant outlet.

15. The evaporator of claim 13, wherein the first hole is provided adjacent to the gas refrigerant outlet and the second hole is provided adjacent to the liquid refrigerant outlet.

16. The evaporator of claim 15, wherein the baffle plate is positioned at a vertical height within the housing that is between the first hole and the second hole.

17. A chilling system, comprising:

a compressor having an impeller that compresses a refrigerant;

a condenser performing heat exchange between refrigerant received from the compressor and chilled water;

an evaporator performing heat exchange between the chilled water and refrigerant discharged from the condenser, the evaporator having distribution device and a heat pipe in which the chilled water for heat exchange with refrigerant distributed by the disibution device flows; and an expansion valve provided between the condenser and the evaporator, wherein the distribution device includes:

a first plate having a first plurality of flow channels extending in a longitudinal direction of the distribution device; and a second plate having a second plurality of flow channels extending a width direction of the distribution device to guide refrigerant received from the first plate therethrough, wherein the first plate includes:

a first refrigerant;

a second refrigerant inlet;

at least one first flow channel extending a longitudinal direction of the first plate from the first refrigerant inlet toward the second refrigerant inlet: and at least one second flow channel extending in the longitudinal direction of the first, plate from the second refrigerant inlet toward the refrigerant inlet.

18. The system of claim 17, wherein the second plate includes:

at least one third flow channel extending in a width direction of the first plate; and at least one fourth flow channel extending in the width direction of the first plate.

19. The system of claim 18, wherein a refrigerant flow direction in the at least one first flow channel is opposite a refrigerant flow direction in the at least one second flow channel, and a refrigerant flow direction in the at. least one third flow channel is opposite a refrigerant flow direction in the at least one fourth flow channel, and wherein the refrigerant flow directions in the first and second flow channels are orthogonal to the refrigerant flow directions in the third and fourth flow channels.

* * * * *